US006870488B1

(12) United States Patent
Compton

(10) Patent No.: US 6,870,488 B1
(45) Date of Patent: Mar. 22, 2005

(54) DRIVEWAY SECURITY SENSOR

(76) Inventor: John L. Compton, Route 5 Box 737A, Blue Field, WV (US) 24701

( * ) Notice: Subject to any disclaimer, the term of this patent is extended or adjusted under 35 U.S.C. 154(b) by 5 days.

(21) Appl. No.: 10/215,289

(22) Filed: Aug. 7, 2002

(51) Int. Cl.[7] ..... G08G 1/01

(52) U.S. Cl. ..... 340/933; 340/330; 340/392.5; 340/539.23; 340/541; 340/551; 340/561

(58) Field of Search ..... 340/330, 933, 340/539.23, 541, 551, 552, 553, 554, 555, 556, 557, 561, 392.5, 326; 348/15.3, 159, 211.2

(56) References Cited

U.S. PATENT DOCUMENTS 3,886,352 A * 5/1975 Lai ..... 340/326
4,843,639 A * 6/1989 Beals ..... 340/825.72
5,208,586 A * 5/1993 Friberg et al. ..... 340/932.2
5,371,489 A * 12/1994 Carroll et al. ..... 340/565
5,448,290 A * 9/1995 VanZeeland ..... 348/153
5,781,108 A * 7/1998 Jacob et al. ..... 340/552
5,831,391 A * 11/1998 MacKay ..... 340/565
6,166,660 A * 12/2000 Grenier ..... 340/932.2
6,392,541 B1 * 5/2002 Bucher et al. ..... 340/541
6,448,894 B1 * 9/2002 Desai ..... 340/505
6,456,322 B1 * 9/2002 Marinacci ..... 348/156

* cited by examiner

*Primary Examiner*—Davetta W. Goins

(57) ABSTRACT

A driveway security sensor having a ground-engaging member connected to a housing body. The ground-engaging member substantively has the shape of a slake. A swivel member is pivotally connected to the housing body, and a motion sensor is connected to the swivel member.

1 Claim, 4 Drawing Sheets

DRIVEWAY SECURITY SENSOR

BACKGROUND OF THE INVENTION

1. Field of the Invention

The present invention relates to a driveway security sensor for use in connection with security sensors. The driveway security sensor has particular utility in connection with driveway security sensor for sensing the presence of a vehicle or individual on the driveway.

2. Description of the Prior Art

Driveway security sensors are desirable for increasing homeowners safety by being made aware of the presence of an individual or vehicle in the homeowners driveway. Current systems turn on security lights at the approach of an individual. A need was felt for a driveway security sensor that would be ground engaging with a pivotal sensor element and would be cooperative with an existing doorbell system.

The use of security sensors is known in the prior art. For example, U.S. Pat. No. 3,798,743 to Griswold discloses a method of installing photoelectric cell in a driveway that allows sensing of the passage of a vehicle or similar object, and a method of installation. The response of a photocell in the present invention when installed near the surface of a driveway is such that the cell output signal changes to the extent required for alarm actuation for a substantial change in incident light. The alarm occurs under a wide range of ambient light conditions normally encountered whereby the alarm can be made to respond to vehicles and not to casual moving shadows. However, the Griswold '743 patent does not have a motion sensor mounted pivotally on a ground engaging housing.

Similarly, U.S. Pat. No. 6,002,332 to King discloses a passive garage door operator system that includes a magnetic field sensor which detects a magnet having a flux density and a transmitter that sends a coded security signal to activate a garage door. A controller determines whether the magnet field sensor detects the magnet from a first direction or a second direction and activates the position of the garage door. The magnetic field sensor is preferably affixed to the underside of a vehicle and the magnets are embedded in a driveway leading to the garage. The system thereby automatically opens a garage door based upon the approach of a vehicle and closes automatically based upon the exit of the vehicle without any intervention by the human vehicle operator. However, the King '332 patent does not have a motion sensor mounted pivotally on a ground engaging housing.

Lastly, U.S. Pat. No. Des 449,010 to Petrucelli discloses a vehicle parking indicator sensor that detects the distance from the parking vehicle to the sensor and lights a series of lights indicating the distance from the vehicle to the sensor. However, the Petrucelli '010 patent does not have a motion sensor mounted pivotally on a ground engaging housing.

While the above-described devices fulfill their respective, particular objectives and requirements, the aforementioned patents do not describe a driveway security sensor that allows driveway security sensor for sensing the presence of a vehicle or individual on the driveway. The Griswold '743, King '332 and Petrucelli '010 patents make no provision for have a motion sensor mounted pivotally on a ground engaging housing.

Therefore, a need exists for a new and improved driveway security sensor which can be used for driveway security sensor for sensing the presence of a vehicle or individual on the driveway. In this regard, the present invention substantially fulfills this need. In this respect, the driveway security sensor according to the present invention substantially departs from the conventional concepts and designs of the prior art, and in doing so provides an apparatus primarily developed for the purpose of driveway security sensor for sensing the presence of a vehicle or individual on the driveway.

SUMMARY OF THE INVENTION

In view of the foregoing disadvantages inherent in the known types of security sensors now present in the prior art, the present invention provides an improved driveway security sensor, and overcomes the above-mentioned disadvantages and drawbacks of the prior art. As such, the general purpose of the present invention, which will be described subsequently in greater detail, is to provide a new and improved driveway security sensor and method which has all the advantages of the prior art mentioned heretofore and many novel features that result in a driveway security sensor which is not anticipated, rendered obvious, suggested, or even implied by the prior art, either alone or in any combination thereof.

To attain this, the present invention essentially comprises a ground-engaging member connected to a housing body. The ground-engaging member substantively has the shape of a stake. A swivel member is pivotally connected to the housing body, and a motion sensor is connected to the swivel member.

There has thus been outlined, rather broadly, the more important features of the invention in order that the detailed description thereof that follows may be better understood and in order that the present contribution to the art may be better appreciated.

The invention may also include a transformer, a sensor wire, a swivel member and a power supply connection. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved driveway security sensor that has all of the advantages of the prior art security sensors and none of the disadvantages.

It is another object of the present invention to provide a new and improved driveway security sensor that may be easily and efficiently manufactured and marketed.

An even further object of the present invention is to provide a new and improved driveway security sensor that has a low cost of manufacture with regard to both materials and labor, and which accordingly is then susceptible of low prices of sale to the consuming public, thereby making such driveway security sensor economically available to the buying public.

Still another object of the present invention is to provide a new driveway security sensor that provides in the apparatuses and methods of the prior art some of the advantages thereof, while simultaneously overcoming some of the disadvantages normally associated therewith.

Even still another object of the present invention is to provide a driveway security sensor for driveway security sensor that has a ground engaging housing.

Still yet another object of the present invention is to provide a driveway security sensor that has a pivotal sensor element.

Lastly, it is an object of the present invention is to provide a driveway security sensor that is cooperative with an existing door bell system.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
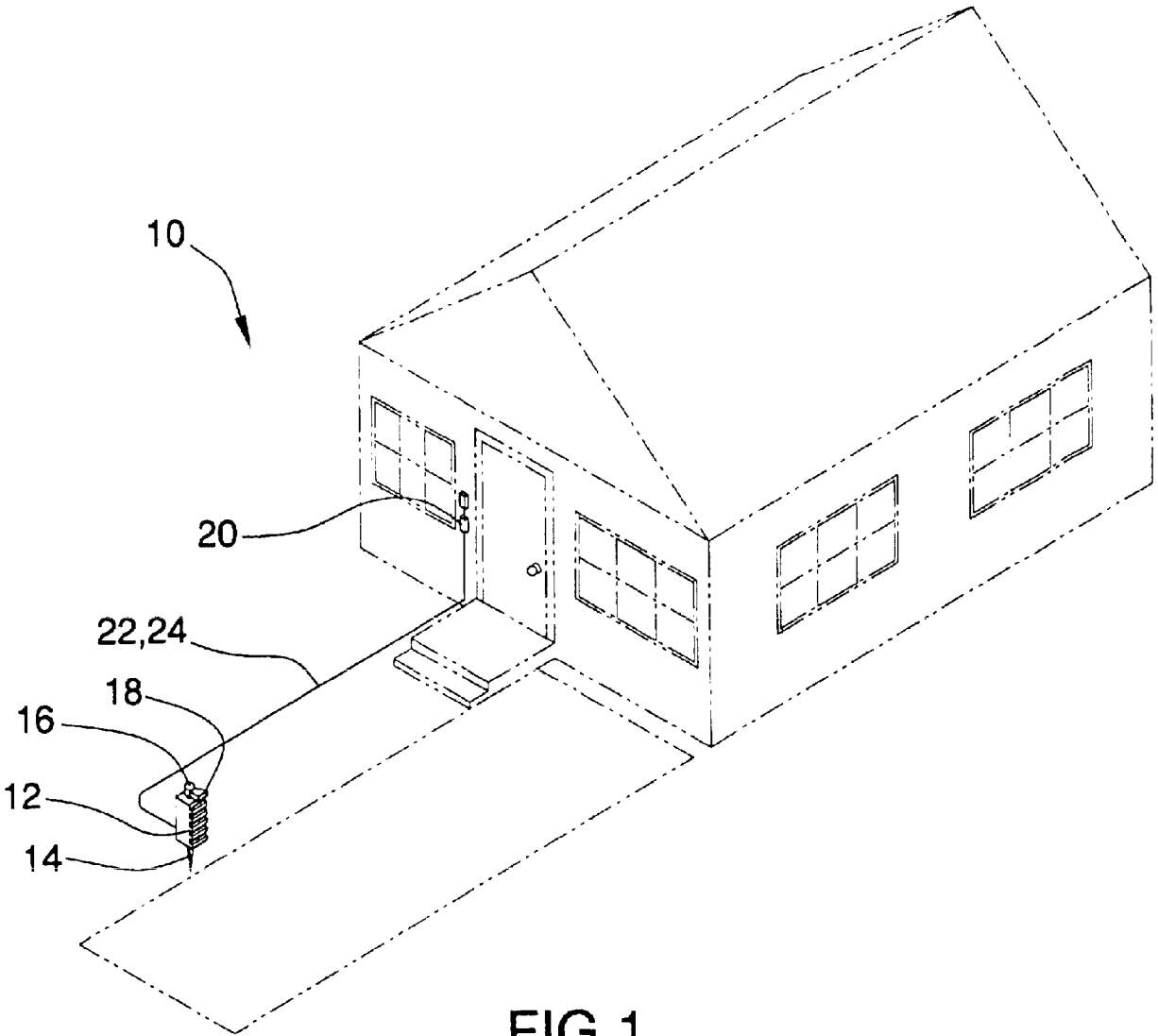
FIG. 1 is a front perspective view of the preferred embodiment of the driveway security sensor constructed in accordance with the principles of the present invention.

Referring now to the drawings, and particularly to FIGS. 1–4, a preferred embodiment of the driveway security sensor of the present invention is shown and generally designated by the reference numeral 10.

In FIG. 1, a new and improved driveway security sensor 10 of the present invention for driveway security sensor for sensing the presence of a vehicle or individual on the driveway is illustrated and will be described. More particularly, the driveway security sensor 10 has a ground engaging member 14 connected to a housing body 12. A motion sensor 16 is connected to the housing body 12. The motion sensor 16 is electrically connectable to the conventional door bell chime. The motion sensor 16 is pivotally connected to the housing body 12. A swivel member 18 is pivotally connected to the housing body 12. The motion sensor 16 is connected to the swivel member 18. The motion sensor 16 is located remotely from the home. A transformer 20 is electrically connected to the motion sensor 16. The transformer 20 is electrically connectable to the conventional door bell chime. A sensor wire 22 electrically connects the motion sensor 16 to the transformer 20. In the present example the motion sensor 16 can be selected from the group consisting of an infrared detector, a reflected light detector and an ultrasonic detector.

Figure 2:
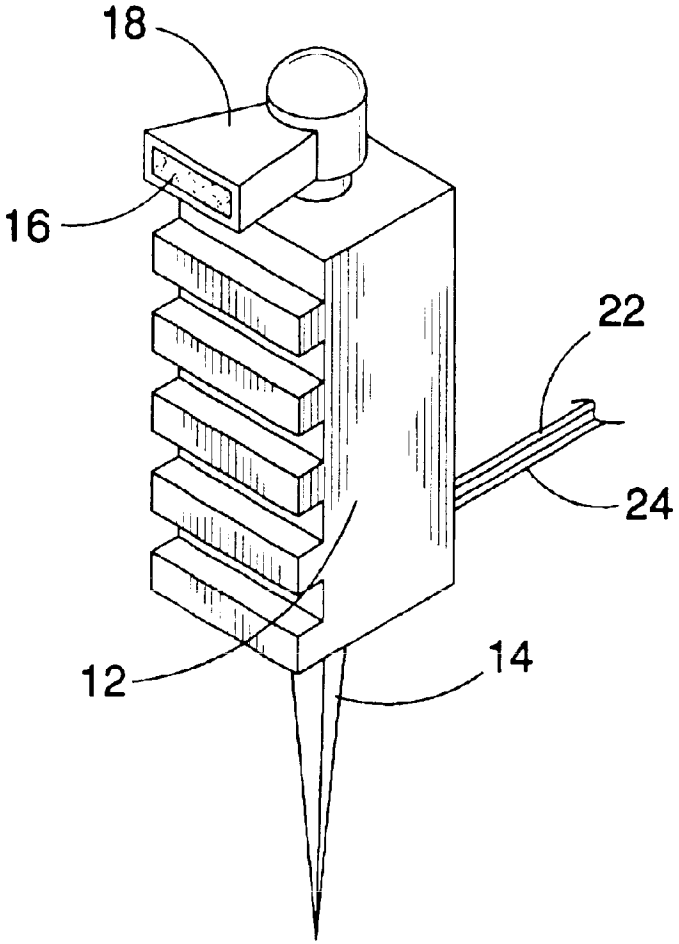
FIG. 2 is a front perspective view of the driveway security sensor of the present invention.

In FIG. 2, the driveway security sensor 10 is illustrated and will be described. The driveway security sensor 10 has the ground engaging member 14 connected to the housing body 12. The ground-engaging member 14 is substantively stake shaped. The swivel member 18 is pivotally connected to the housing body 12. The motion sensor 16 is connected to the swivel member 18. The sensor wire 22 is electrically connected to the motion sensor 16. A power supply connection 24 is electrically connected to the motion sensor 16.

Figure 3:
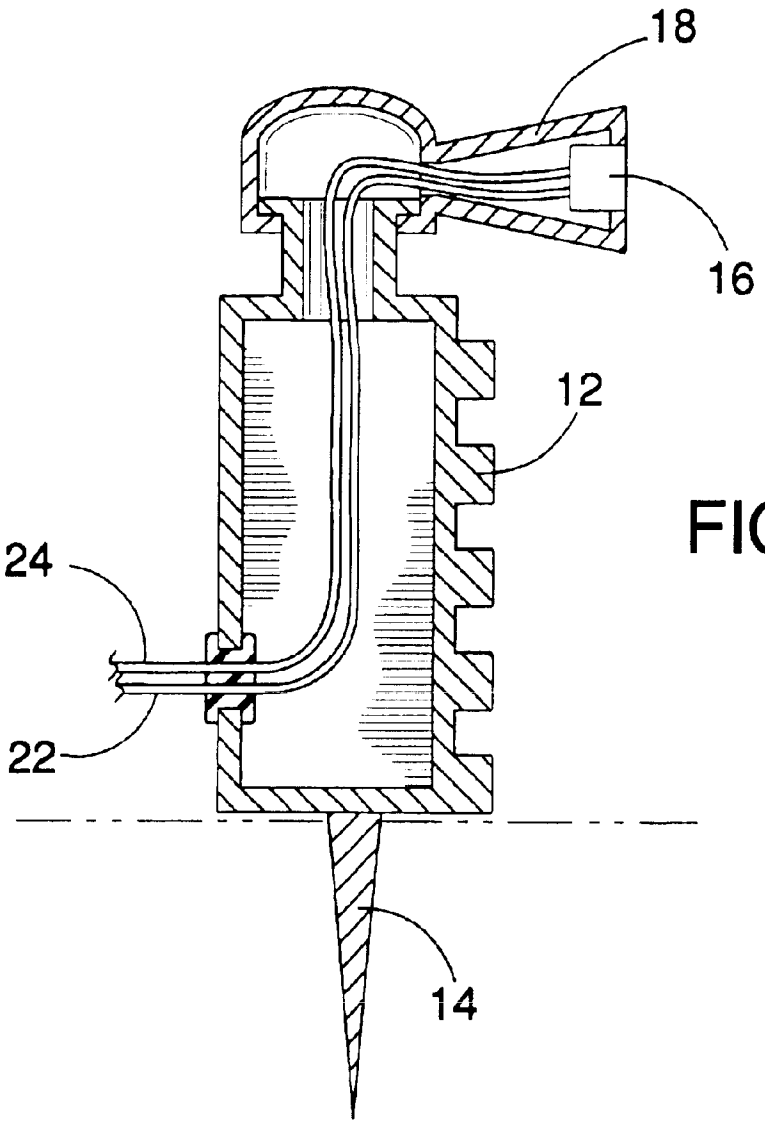
FIG. 3 is a section view of the driveway security sensor of the present invention.

In FIG. 3, the driveway security sensor 10 is illustrated and will be described. The driveway security sensor 10 has the ground engaging member 14 connected to the housing body 12. The ground-engaging member 14 is substantively stake shaped. The swivel member 18 is pivotally connected to the housing body 12. The motion sensor 16 is connected to the swivel member 18. The sensor wire 22 is electrically connected to the motion sensor 16. The power supply connection 24 is electrically connected to the motion sensor 16.

Figure 4:
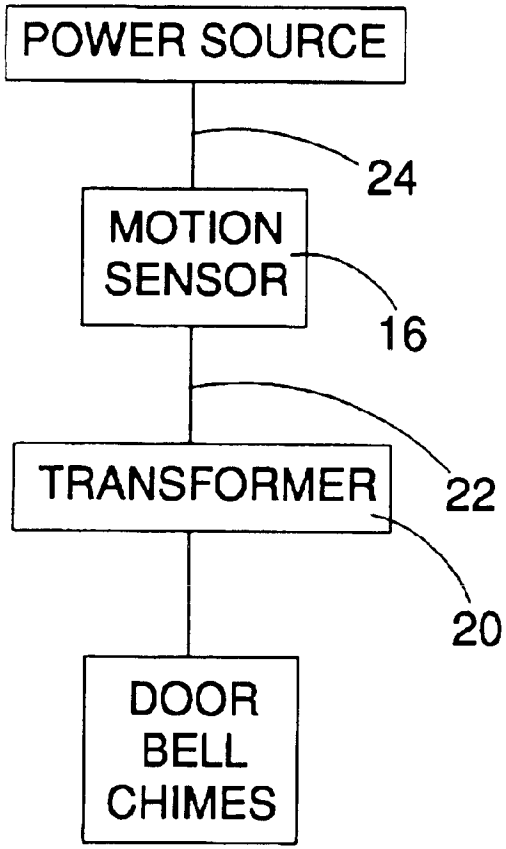
FIG. 4 is a block diagram view of the driveway security sensor of the present invention.

In FIG. 4, the driveway security sensor 10 is illustrated and will be described. The power supply connection 24 is electrically connected to the motion sensor 16. The sensor wire 22 is electrically connected to the motion sensor 16. The transformer 20 is electrically connected to the sensor wire 22. The transformer 20 electrically connectable to the conventional door bell chime.

In use, it can now be understood that the driveway security sensor 10 is placed with the ground engaging member 14 into the earth next to the driveway with the motion sensor 16 and swivel member 18 pointed in the direction of the driveway. When a vehicle arrives in the driveway the doorbell will chime.

While a preferred embodiment of the driveway security sensor has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal may be used instead of the plastic described. And although driveway security sensor for sensing the presence of a vehicle or individual on the driveway have been described, it should be appreciated that the driveway security sensor herein described is also suitable for sensing the presence of individuals in other environments.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A driveway security sensor comprising:

a housing body;

a ground engaging member connected to said housing body, said ground engaging member substantively having the shape of a stake;

a swivel member pivotally connected to said housing body;

an ultrasonic motion sensor connected to said swivel member;

a sensor wire electrically connected to said motion sensor;

a transformer electrically connected to said sensor wire, said transformer electrically connectable to a conventional door bell chime; and a power supply connection electrically connected to said motion sensor.

* * * * *